US006417752B1

(12) United States Patent
Heritier-Best et al.

(10) Patent No.: US 6,417,752 B1
(45) **Date of Patent: *Jul. 9, 2002**

(54) IGNITION COIL

(75) Inventors: Pierre Heritier-Best, Orbeil; Olivier Metzelard, Issoire, both of (FR)

(73) Assignee: Sagem S.A., Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/147,528

(22) PCT Filed: Jul. 16, 1997

(86) PCT No.: PCT/FR97/01318

§ 371 (c)(1),
(2), (4) Date: Mar. 24, 1999

(87) PCT Pub. No.: WO98/03791

PCT Pub. Date: Jan. 29, 1998

(30) Foreign Application Priority Data

Jul. 17, 1996 (FR) ..... 96 08936

(51) Int. Cl.[7] ..... H01F 27/02

(52) U.S. Cl. ..... 336/90; 336/92; 336/107

(58) Field of Search ..... 336/107, 100, 336/83, 90, 92; 123/634, 635, 621

(56) References Cited

U.S. PATENT DOCUMENTS

| | | | | |
|---|---|---|---|---|
| 1,302,308 A | * | 4/1919 | Cavanagh | 336/107 |
| 5,101,803 A | * | 4/1992 | Nakamura et al. | 123/634 |
| 5,736,917 A | * | 4/1998 | Kawano et al. | 336/90 |
| 5,778,863 A | * | 7/1998 | Oosuka et al. | 123/634 |
| 5,870,012 A | * | 2/1999 | Sakamaki et al. | 336/107 |

* cited by examiner

*Primary Examiner*—Lincoln N. Donovan
*Assistant Examiner*—Tarifur T. Nguyen
(74) *Attorney, Agent, or Firm*—Dennison, Schultz & Dougherty

(57) ABSTRACT

The subject of the invention is an ignition coil, of the type intended to be mounted on a spark plug for the individual electrical supply of this spark plug, comprising an internal secondary winding (2), an external primary winding, a flux return shell (9) and a casing (4). According to the invention, the said casing (4) surrounds only the secondary winding, the primary winding being wound onto the casing, on the outside of the latter; and being itself surrounded by the flux return shell.

8 Claims, 2 Drawing Sheets

IGNITION COIL

FIELD OF THE INVENTION

The present invention relates to an ignition coil, of the type intended to be mounted on a spark plug for the individual electrical supply of this spark plug.

BACKGROUND OF THE INVENTION

Such coils, comprising a magnetic core, a tubular secondary holder inside which is placed the core and onto which the secondary wire is wound, this assembly being placed in the primary holder onto which the primary wire is wound, are known. A slit metal tubular shell, for avoiding eddy currents, is placed around the assembly in order to ensure the return of the magnetic flux and the whole assembly being contained in a plastic casing.

However, it is known that these coils must have a small diameter since they are housed in wells of the engine's cylinder head, immediately above the spark plugs that they supply.

It is important for the radial distance between the primary and the secondary to be as large as possible. This is because, when this distance increases the capacitance of the secondary decreases and the breakdown voltage increases. Furthermore, in the case in which, because of the thermal shocks to which the spark plug could be subjected, microcracks occur, it is advantageous to increase the arc breakdown path.

The problem stems from the fact that the external diameter of the casing is fixed by the diameter of the wells. Moreover, most of the dimensional parameters of the coil are set by its electrical properties. The casings must therefore be as thin as possible, and hence they are difficult to produce and are expensive in terms of scrap.

SUMMARY OF THE INVENTION

The present invention aims to remedy these drawbacks.

For this purpose, the subject of the invention is an ignition coil, of the type intended to be mounted on a spark plug for the individual electrical supply of this spark plug, comprising an internal secondary winding, an external primary winding, a flux return shell and a casing, characterised in that the said casing surrounds only the secondary winding, the primary winding being wound onto the casing, on the outside of the latter, and being itself surrounded by the flux return shell.

Because the primary is wound directly onto the casing, the primary holder may be dispensed with. Alternately, if the element on which the primary winding is wound is considered to be the primary winding holder, then this element forms a portion of the outside of the ignition coil and a casing is no longer necessary. However, in this disclosure, the element that supports the primary winding, which also forms a portion of the outer surface of the ignition coil and surrounds the core and secondary winding, is usually referred to as the casing. The casing can therefore be thick and consequently manufactured much more easily. Furthermore, it forms part of the insulation and greatly reduces the risks of flashover between the high-voltage terminal and the primary winding.

In one particular embodiment, the casing is in the form of a body of revolution, the external surface of which has a first annular recess, for accommodating the flux return shell, and a second annular recess, axially and radially more deeply included in the first, for accommodating the primary winding.

One particular embodiment of the invention will now be described, by way of non-limiting example, with reference to the appended schematic drawings in which:

DETAILED DESCRIPTION OF A PREFERRED EMBODIMENT

Figure 1:
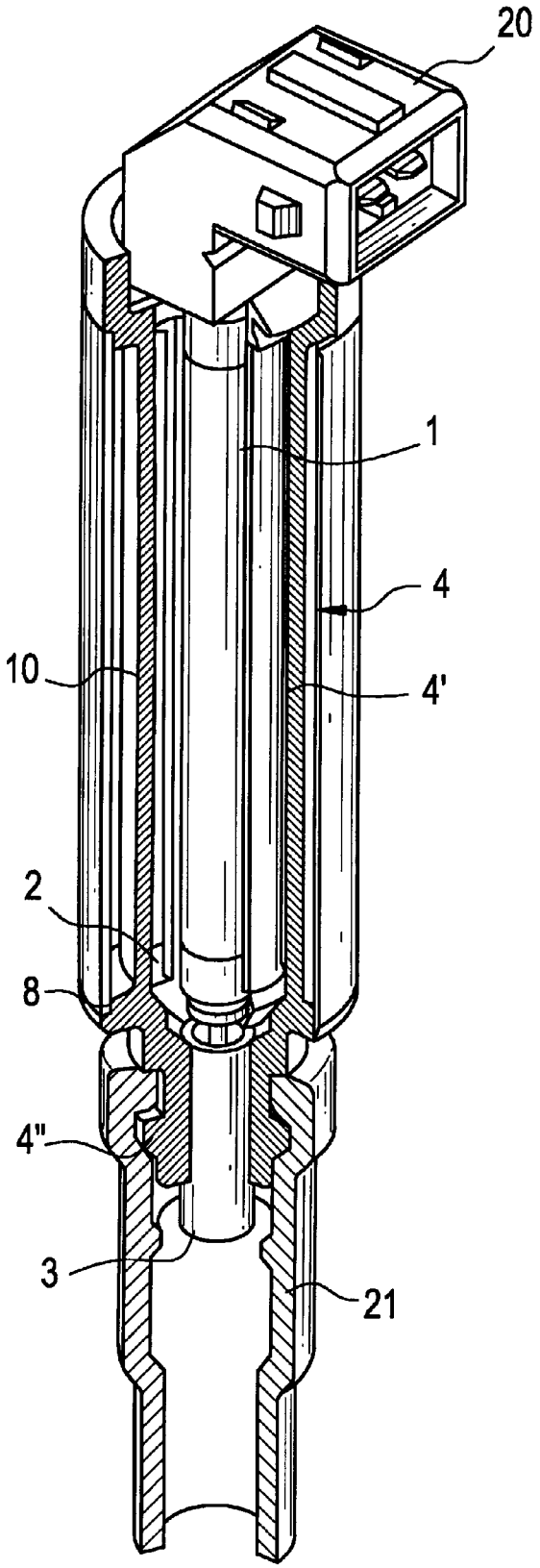
FIG. 1 is a cut-away perspective view of a coil according to the invention.
Figure 2:
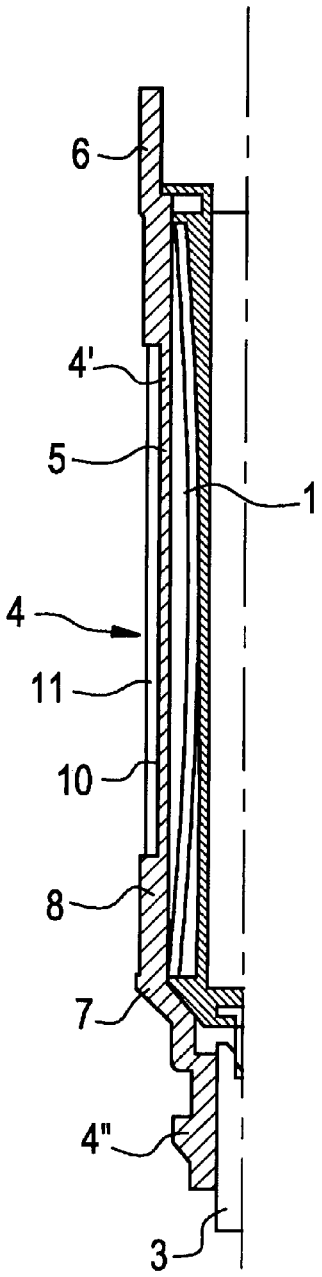
FIG. 2 is a half axial sectional view of this coil.
Figure 3:
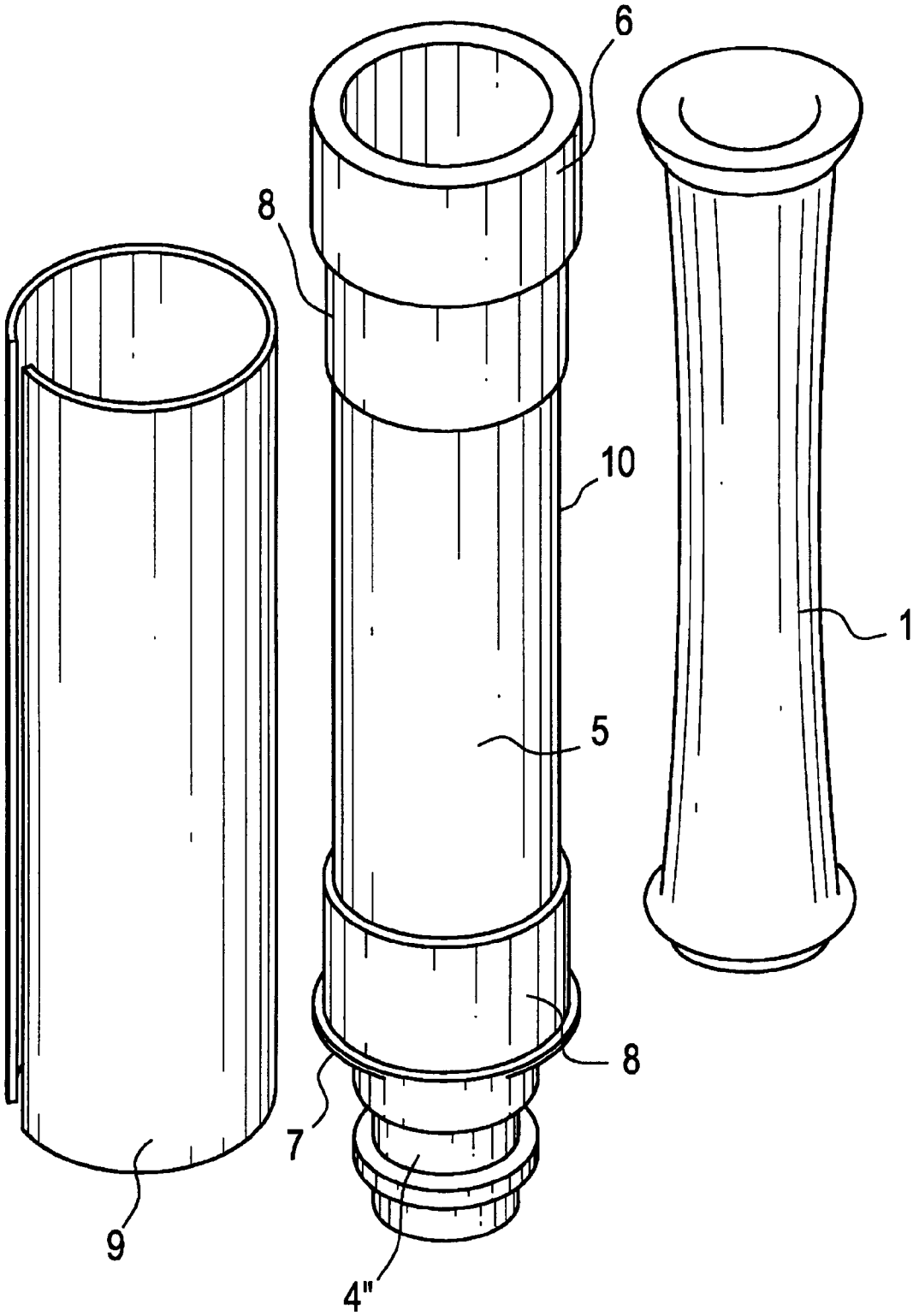
FIG. 3 is an exploded perspective view of some of its components.

The coil shown in the figures comprises, in a known manner, a secondary holder 1 onto which the secondary wire 2 is wound. This secondary wire is electrically connected to a high-voltage terminal 3.

The casing 4 according to the invention is placed around the secondary winding. This casing is tubular and the secondary assembly is placed inside it.

The casing 4, made of moulded plastic, is axisymmetric and comprises essentially a body 4' and an extension 4" which surrounds the high-voltage terminal 3. The body 4' is composed of a central cylindrical part 5, an upper end flange 6 and a lower flange 7 which separates the part 5 from the extension 4".

The cylindrical part 5 has two stepped annular recesses. The first recess 8 accommodates the flux return shell 9, the latter consisting of a rolled metal sheet slit along one of its generatrices. A second recess 10, lying within this first recess, accommodates the primary winding between its bottom and the shell 9.

According to the invention, the casing 4 is therefore located between the two windings.

Finally, the coil comprises, in a known manner, in its upper part, a connector 20 for supplying the primary winding and, in its lower part, an end-fitting 21 for sealing the spark plug. Other sealed terminations may be envisaged.

In one embodiment, the casing 4 is overmoulded directly onto the secondary winding, optionally covered by a shrinkable sleeve which may or may not be coated on the inside with adhesive. Thus, the presence of air is avoided, this having the effect of eliminating any high-voltage corona discharge.

What is claimed is:

1. A spark-plug-mounted ignition coil having an exterior surface for suppling electricity to a spark plug comprising:

a primary winding support having an interior and an exterior surface having a first portion and a second portion, a primary winding wound on the first portion of the exterior surface of said primary winding support;

a core in the interior of said primary winding support;

a secondary winding wound on said core; and, a flux return shell mounted on the exterior surface of said primary winding support over said primary winding;

wherein said flux return shell and said second portion of said primary winding support comprise the exterior surface of said ignition coil.

2. A coil according to claim 1, in which the primary winding support is in the form of a body of revolution and the exterior surface of the primary winding support includes a first annular recess for accommodating the flux return shell and a second annular recess in the first annular recess for accommodating the primary winding.

3. A coil according to claim 1 wherein said primary winding support includes a first area for receiving a connector.

4. Coil according to claim 3 further including a high voltage terminal wherein said primary winding support includes a second area surrounding said high voltage terminal.

5. A spark-lug-mounted ignition coil having an exterior surface for supplying electricity to a spark plug comprising:

a casing having an interior and an exterior surface having a first portion and a second portion;

a core mounted within said casing;

a secondary winding wound on said core;

a primary winding wound on said casing; and, a flux-return shell mounted on said first portion of said casing outer surface;

said flux return shell and said second portion of said casing comprising the exterior surface of said coil.

6. A coil according to claim 5, wherein the casing is in the form of a body of revolution and the external surface of the casing includes a first annular recess for accommodating the flux return shell and a second annular recess in the first annular recess for accommodating the primary winding.

7. A coil according to claim 6 wherein said casing includes a first area for receiving a connector.

8. A coil according to claim 7 further including a high voltage terminal wherein said casing includes a second area surrounding said high voltage terminal.

* * * * *